US008196428B2

(12) United States Patent
Meltzer

(10) Patent No.: US 8,196,428 B2
(45) Date of Patent: Jun. 12, 2012

(54) BEAD DISPLAY DEVICE AND METHOD OF BEAD DISPLAY

(76) Inventor: Alan L. Meltzer, Wayland, MA (US)

( * ) Notice: Subject to any disclaimer, the term of this patent is extended or adjusted under 35 U.S.C. 154(b) by 427 days.

(21) Appl. No.: 12/583,020

(22) Filed: Aug. 14, 2009

(65) Prior Publication Data

US 2011/0132036 A1 Jun. 9, 2011

(51) Int. Cl.
*A44C 17/02* (2006.01)

(52) U.S. Cl. ..... 63/29.1; 63/38

(58) Field of Classification Search ..... None
See application file for complete search history.

(56) References Cited

U.S. PATENT DOCUMENTS 2,079,043 A * 5/1937 Samstag ..... 63/1.15
4,052,864 A * 10/1977 Hofsaess ..... 63/31
4,977,757 A * 12/1990 Mesica et al. ..... 63/15
6,318,122 B1 * 11/2001 Burgard ..... 63/29.1

* cited by examiner

*Primary Examiner* — Jack W. Lavinder
(74) *Attorney, Agent, or Firm* — William Nitkin

(57) ABSTRACT

A display device and method of bead display for mounting an ornamental bead on a piece of jewelry in a bead receipt area having a curved light-reflective area for directing ambient and reflected light through and/or against the ornamental bead to highlight and illuminate the ornamental bead.

4 Claims, 1 Drawing Sheet

BEAD DISPLAY DEVICE AND METHOD OF BEAD DISPLAY

BACKGROUND OF THE INVENTION

1. Field of the Invention

The device and method of this invention reside in the field of jewelry and more particularly relate to a device having light-reflective properties for the mounting and display of an ornamental bead in various types of jewelry.

2. Description of the Prior Art

Decorative beads used in jewelry are extremely popular as they can be used interchangeably to highlight particular colors of one's wardrobe. Such decorative bead are composed of glass or other materials and are generally spherical in shape with an aperture passing therethrough. Such beads are typically flattened at the ends of each side of the bead where the apertures are located. Ornamental beads can be strung on a chain or otherwise displayed in a wide variety of ways. The prior art is replete with patents on structures for the display of such beads, such as U.S. Pat. No. 6,318,122 to Burgard for an Interchangeable Ornament Jewelry Display.

SUMMARY OF THE INVENTION

It is an object of this invention to provide a unique device for the display of an ornamental bead which device provides light reflectance through the bead if the bead is transparent or translucent and provides light reflectance around the bead if the bead is opaque and highlights the bead on the jewelry on which the bead is mounted. The device of this invention can be incorporated in a ring, brooch, pendant or other item of jewelry.

It is a further object of this invention to provide a method for displaying an ornamental bead in a concave light-reflective area of a piece of jewelry.

DESCRIPTION OF THE PREFERRED EMBODIMENT(S)

Figure 1:
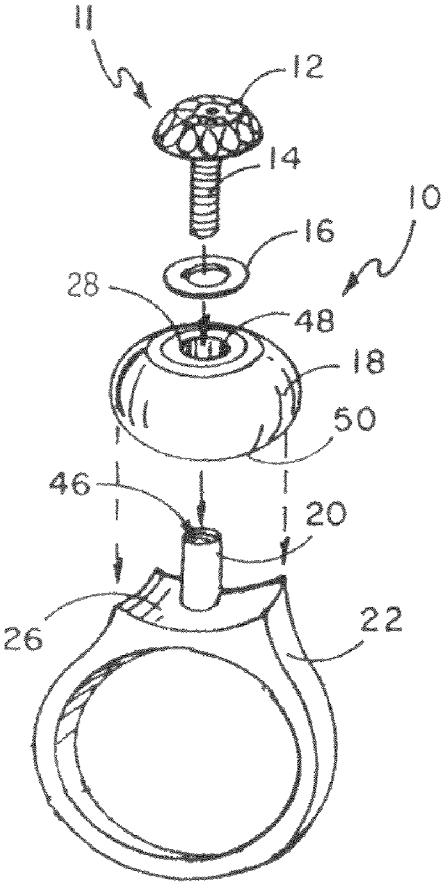
FIG. 1 illustrates an exploded perspective view of the display device of this invention incorporated in a ring, showing an ornamental bead about to be mounted thereon.

FIG. 1 illustrates an exploded perspective view of the display device 10 of this invention incorporated in ring 22, showing ornamental bead 18 about to be mounted thereon. Bead 18 is of the type having bead aperture 28 defined therein passing therethrough. Bead 18 is generally spherical and flattened on top side 48 and bottom side 50 at the openings of bead aperture 28. Ring 22 has a bead receipt area 26 defined therein which has a light-reflective, concave surface. The curvature of bead receipt area 26 is designed to match the curvature of both the top and bottom sides of bead 18. In a central portion of bead receipt area 26 is an upwardly extending hollow screw receipt shaft 20 having a receipt shaft aperture 46. Screw receipt shaft 20 is of a height and size to pass through bead aperture 28. Hollow screw receipt shaft 20 is threaded on its interior with such threading matching the outer threading on screw shaft 14. During the mounting process, bead 18 is positioned onto screw receipt shaft 20 in bead receipt area 26 and pushed against ring 22. Once the bead is in place on screw receipt shaft 20 in bead receipt area 26, screw shaft 14 of screw member 11 having a decorated top member 12 is passed through resilient washer 16 and into bead aperture 28 and threaded into receipt shaft aperture 46 which has mating threads on its interior so that screw shaft 14 can be tightened against resilient washer 16 to securely hold bead 18 in place and not damage the bead when it is tightened against ring 22. Top member 12 of screw member 11 can be decorative in nature and can have one of a plurality of selected artistic designs formed thereon. When screw shaft 14 is tightened into screw receipt shaft 20, top member 12 forms a part of display device 10 to showcase ornamental bead 18 on ring 22 and covers top side 48 and bead aperture 28 of bead 18. The device of this invention allows for the interchangeability of ornamental beads from a collection of beads that an owner may possess. The use of a concave, highly reflective bead receipt area 26 having screw receipt shaft 20 protruding upward therefrom for the bead to be positioned thereon, allows the bead, whether transparent, translucent or opaque, to have reflective light either pass therethrough or simply highlight the bead for a more aesthetic display of the ornamental bead on a piece of jewelry.

Figure 2:
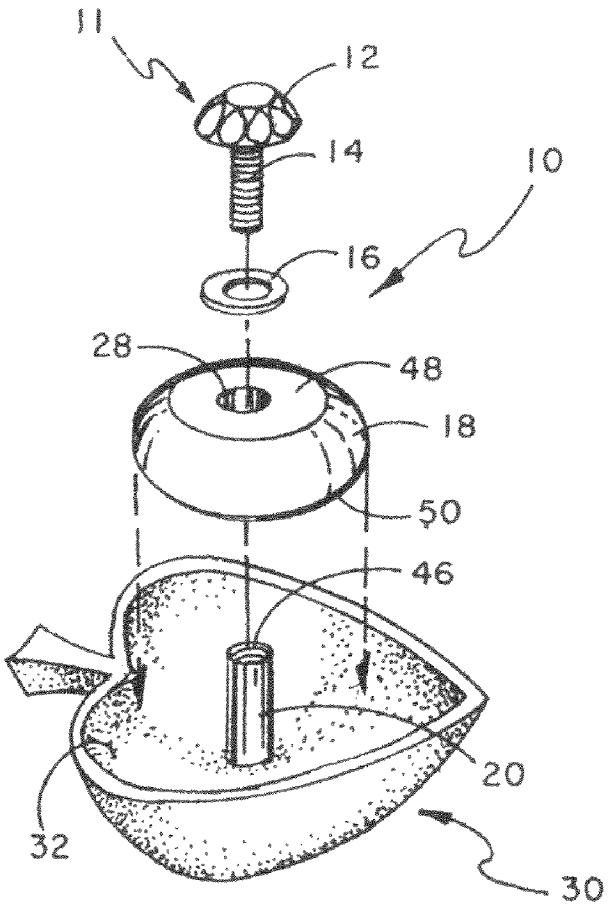
FIG. 2 illustrates an exploded perspective view of the display device of this invention incorporated in a brooch, showing an ornamental bead about to be mounted thereon.

FIG. 2 illustrates an embodiment of the display device of this invention incorporated in brooch 30. Although curved reflective receipt area 32 is generally larger in size than the size of bottom side 50 of bead 18, they have mating curvatures. Curved reflective receipt area 32 has a central portion from which screw receipt shaft 20 extends upwards and is of a size that is adapted to fit through bead aperture 28. Screw receipt shaft 20 is hollow and threaded on its interior 46 for receiving the mating threads of screw shaft 14 which can be passed through resilient washer 16, into bead aperture 28 of bead 18 and threaded into bead aperture 28 to tighten the bead in place within curved reflective receipt area 32 of brooch 30. Since the surface area of reflective receipt area 32 of brooch 30 is even larger around the bead than bead receipt area 26 in ring 22, the bead in brooch 30 is more illuminated by light reflection striking it from its sides; and if the bead is transparent or translucent, the bead is further illuminated by light reflecting from below the bead. In all embodiments of use of the display device of this invention, the display device highlights the ornamental bead by means of light reflectance.

Figure 3:
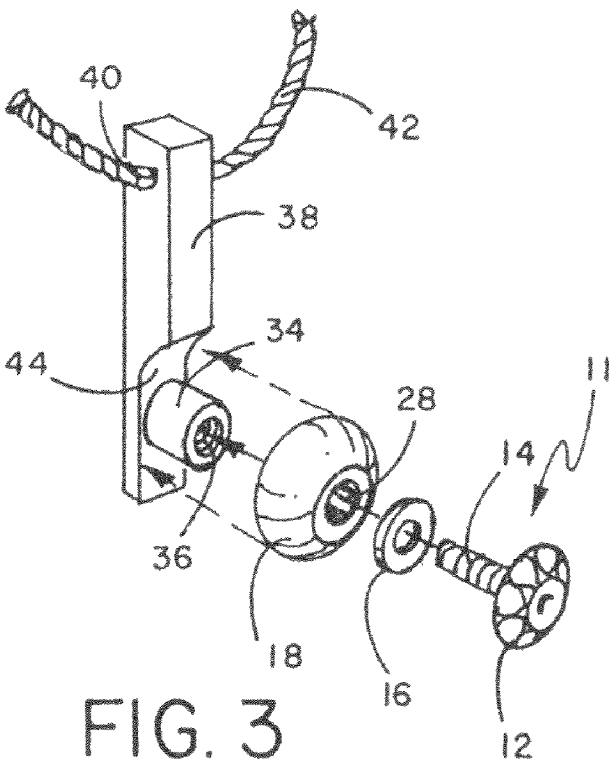
FIG. 3 illustrates an exploded perspective view of the display device of this invention incorporated in a pendant, showing an ornamental bead about to be mounted thereon.

FIG. 3 illustrates a further embodiment of the display device of this invention incorporated within pendant 38, showing pendant 38 suspended from a cord or chain 42 that passes through pendant aperture 40 and to support pendant 38 hanging generally from the neck. The same structure can also be used as part of a bracelet or other hanging jewelry item. The pendant can be of any size or configuration. Disposed on a portion of the pendant is curved receipt area 44 which also can be highly polished and light-reflective in nature. Seat 34 has a seat receipt aperture 36 defined therein which seat receipt aperture 34 is threaded and receives the end of screw shaft 14 of screw member 11. Seat receipt aperture 36 has mating threading with the threads of screw shaft 14. When screw shaft 14 is passed through bead aperture 28 after passing through resilient washer 16, bead 18 is tightened against seat 34, attaching the bead to the pendant. Bead 18 is held thereby above the curved reflective receipt area 44 for more intense light reflections around the bead for highlighting the selected ornamental bead mounted thereon. Top member 12 of screw member 11 can also be formed in a variety of decorative shapes and/or decorated surfaces to enhance display of the chosen ornamental bead.

The reflective receipt areas of the ring, brooch, pendant or other piece of jewelry can be made, in one embodiment, of polished silver or other light-reflective surface, such light reflectiveness enhancing the display of the ornamental beads which can be selected from a multiplicity of beads in desired shapes, designs and colors.

Although the present invention has been described with reference to particular embodiments, it will be apparent to those skilled in the art that variations and modifications can be substituted therefor without departing from the principles and spirit of the invention.

I claim:

1. A method for the display of an ornamental bead on a piece of jewelry, said ornamental bead having a size, a top side and a bottom side, said bottom side having a curvature and an area, and an aperture defined in said bead, said aperture having a length that passes through said top side to said bottom side of said ornamental bead, comprising:

providing a bead receipt area defined in said piece of jewelry;

providing a protruding screw receipt shaft having a hollow interior defined therein;

positioning said screw receipt shaft having a base in a central portion of said bead receipt area;

mounting said ornamental bead on said screw receipt shaft with said bead aperture passing over said screw receipt shaft;

disposing said bottom side of said ornamental bead against said bead receipt area;

providing said interior of said screw receipt shaft with screw threads;

providing a concave light-reflective area in said bead receipt area;

providing a screw member having a screw top and a screw shaft, said screw shaft having mating threading with said threading on said interior of said screw receipt shaft;

passing said screw member through said bead aperture;

tightening said screw member into said threaded portion of said screw receipt shaft;

retaining said ornamental bead in position on said screw receipt shaft within said concave light-reflective area of said piece of jewelry; and reflecting light from said concave light-reflective area onto said ornamental bead.

2. The method of claim 1 further including the step of mating said curvature of said bottom side of said ornamental bead to said concave light-reflective area in said bead receipt area.

3. The method of claim 2 further including the steps of:

providing said curved light-reflective area having an area greater than said area of said bottom side of said ornamental bead; and causing light to be reflected around said ornamental bead for enhancing the display of said ornamental bead.

4. The method of claim 1 further including the steps of:

providing a seat in said screw receipt shaft, said seat having a threaded aperture defined therein for enabling said bottom side of said ornamental bead to rest on said seat and be held thereto by said screw member passing through said bead aperture and being threaded into said threaded aperture; and allowing light reflected by said concave light-reflective area to illuminate said ornamental bead.

* * * * *